US006576855B2

(12) United States Patent
Levendis et al.

(10) Patent No.: US 6,576,855 B2
(45) Date of Patent: Jun. 10, 2003

(54) ROCKER SWITCH

(75) Inventors: Marina Levendis, Boston, MA (US); Dana Paul Scribner, West Groton, MA (US); Steven David Mayer, Sherborn, MA (US); Henry Garratt Grilk, Lincoln, RI (US)

(73) Assignee: Cole Hersee Co., South Boston, MA (US)

( * ) Notice: Subject to any disclaimer, the term of this patent is extended or adjusted under 35 U.S.C. 154(b) by 0 days.

(21) Appl. No.: 09/776,440

(22) Filed: Feb. 2, 2001

(65) Prior Publication Data

US 2002/0104748 A1 Aug. 8, 2002

(51) Int. Cl.[7] ..... H01H 23/00; H01H 3/20; H01H 9/00

(52) U.S. Cl. ..... 200/339; 200/315; 200/556; 200/517

(58) Field of Search ..... 200/5 R, 5 A, 200/339, 512–517, 553–562, 315

(56) References Cited

U.S. PATENT DOCUMENTS 5,087,798 A * 2/1992 Rohde et al. ..... 200/5 A
5,752,595 A * 5/1998 Fein et al. ..... 200/315
5,803,243 A * 9/1998 Nestor et al. ..... 200/556
6,013,885 A * 1/2000 Kowalczyk ..... 200/315

* cited by examiner

*Primary Examiner*—J. R. Scott
(74) *Attorney, Agent, or Firm*—Nields & Lemack

(57) ABSTRACT

A switch, especially for heavy duty vehicle applications, utilizes solid state circuitry and a low voltage, low current touch pad switch, where the switching occurs directly on a printed circuit board and bulky wire terminations are eliminated. The switch includes a rocker, which pivots at its center point fulcrum causing the switch lever, housed inside the switch and attached to the rocker, to move in a particular direction. The configuration of the lever is such that the extending ears on opposite sides press against the elastomer seal and move a carbon contact against the integrated circuit traces on a printed circuit board, completing an electrical circuit. This condition occurs for either directional movement of the rocker. Housed within the lever is a spring-loaded plunger fitted with a roller (wheel) at its end. The roller rests on a predesigned detented ramp located as an integral part of the switch insulator.

9 Claims, 4 Drawing Sheets

ROCKER SWITCH

BACKGROUND OF THE INVENTION

The present invention relates to the field of electrical switches, particularly panel switches especially useful for control applications, including on-highway heavy duty trucks and other heavy duty vehicles, off-highway equipment (such as construction equipment and agricultural equipment), marine and automotive applications, for example.

Conventional rocker switches are often used in automotive applications, where it is desirable to provide the vehicle operator with discernible feedback on the position of the switch without distracting the operator from his or her primary function of driving. Such rocker switches have traditionally been designed to switch and carry relatively high amps, typically from about 10 amps to as high as 25 amps. As a result, conventional rocker switches have found wide acceptance in switching virtually every circuit commonly found in the particular application. This proliferation of rocker switches on instrument panels has given rise to a complex and expensive "rats nest" of large gauge wires behind the panel, which contributes to a similarly complex and expensive wiring harness leading from the panel to the devices being controlled.

One alternative to the foregoing is to "multiplex" the system using a suitable digital data bus. The switches on the panel would be connected to a locally mounted electronics module with short, direct leads or cable assemblies. The local module would then be connected to a remotely mounted control module or power distribution module. The interconnection between the local and remote modules would typically consist of a simple twisted pair of wires instead of the very complex and expensive heavy gauge wiring harness.

However, it has proven difficult to make use of conventional "high current" rocker switches in the above application. In a very low current application, intermittent operation often occurs, primarily due to the buildup of corrosion and/or oxidation on the contacts of the switch. This corrosion/oxidation layer, while microscopically thin, is sufficient to cause a high contact resistance and inadequate circuit operation in very low current switching applications. The corrosion/oxidation also can yield a leakage current path that can deleteriously impact the performance of digital electronics circuitry. This leakage current is insignificant compared to the many amperes typically carried with a conventional rocker switch, but it is a significant factor compared to the microamps in the digital electronics circuit.

It would therefore be desirable to provide a panel switch having the appearance and ergonomics of a conventional rocker switch that is designed for applications where the current being switched is in the microamp to low milliamp range.

SUMMARY OF THE INVENTION

The problems of the prior art have been overcome by the present invention, which provides a switch, especially for heavy duty vehicles, construction and agricultural equipment and automotive applications, configured to meet all types of operator input, including momentary positions, fixed positions, increased intensity back lighting, fixed position illumination, panel markings, push on/push off and audible support. The design utilizes solid state circuitry which minimizes design variations, results in flexible connector choices, requires minimal wiring, and eliminates the failure potential existing in conventional contact dependent switches. In addition, problems associated with high current switching contacts is eliminated by using a low voltage, low current touch pad switch, where the switching occurs directly on a printed circuit board and bulky wire terminations are eliminated. Since contacts only switch very low voltage and very low current, contact wear is virtually non-existent, and the switch can be directly coupled to one or more microprocessors without the need to step down the voltage or current.

The switch of the present invention is typically used in automotive and other control applications, placed in the dash panel an operated by a user by actuating the rocker. When one end of the rocker is pressed, the rocker pivots at its center point fulcrum causing the switch lever, which is housed inside the switch and attached to the rocker, to move in a particular direction. The configuration of the lever is such that the extending ears on opposite sides press against the elastomer seal and move a carbon contact against the integrated circuit traces on a printed circuit board, completing an electrical circuit. This condition occurs for either directional movement of the rocker. Housed within the lever is a spring-loaded plunger fitted with a roller (wheel) at its end. The roller rests on a predesigned detented ramp located as an integral part of the switch insulator.

A sealed elastomer keypad is used to meet the reliability requirements in microamp and low milliamp applications. Actual circuit connectivity is achieved by pressing a carbon-based contact against a set of selectively metal plated interdigitated contact fingers such that the carbon contact causes a "short" across the fingers. The resultant contact resistance is less than 200 Ohms, and is typically in the 10–20 Ohm range.

DETAILED DESCRIPTION OF THE INVENTION

Figure 1B:
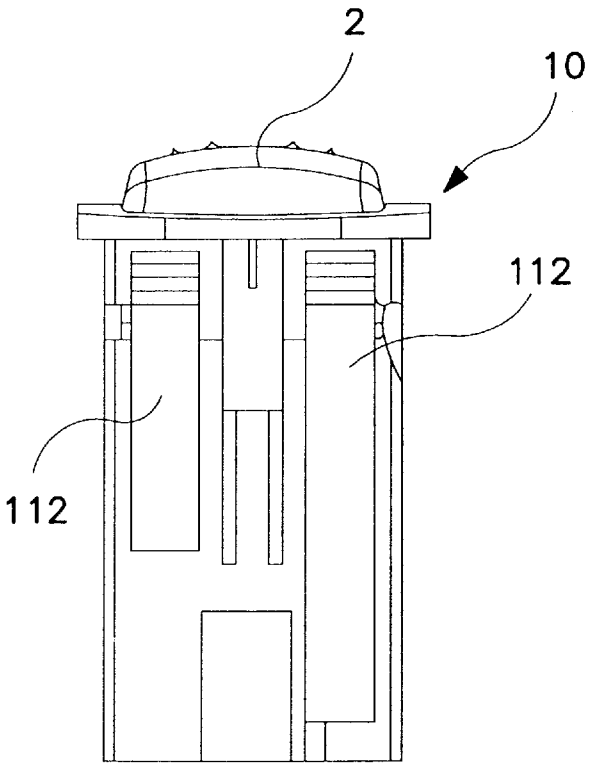
FIG. 1 is a side view of the switch housing in accordance with the present invention.
FIG. 1A is a front view of the switch housing of FIG. 1.
Figure 1A:
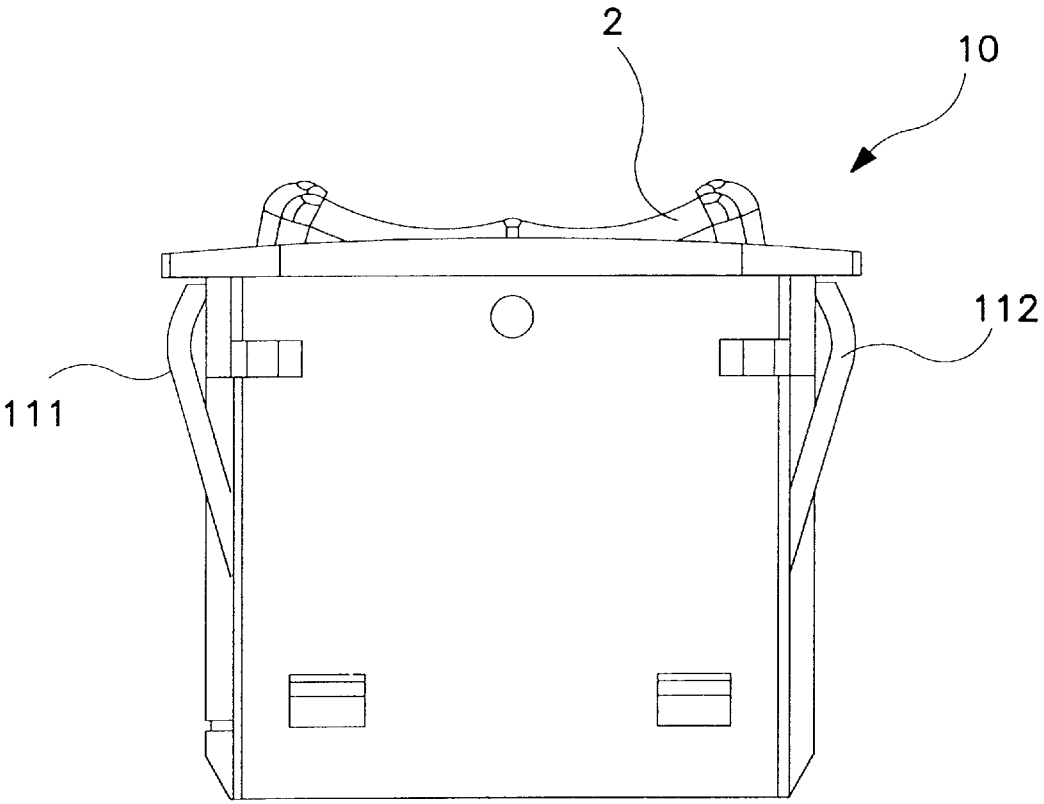

Turning first to FIGS. 1 and 1A, a suitable housing 10 is shown for the switch of the present invention. The housing is preferably insulating and is preferably constructed of a durable plastic, such as acrylonitrile-butadiene-styrene (ABS) or polycarbonate, both with or without fiberglass filling. ABS has excellent surface appearance, strength and stiffness, toughness, chemical resistance, and processing ease and versatility. The housing includes opposite flexible wings 111, 112 which lock the switch in place, such as in an automotive dashboard. More than one wing may be used on each side, as shown in FIG. 1. A rocker 2 is positioned on the front face of the housing 10 for actuation of the switch. The rocker 2 may bear appropriate indicia, indicating to the operator the function to be controlled by switch actuation.

Figure 2A:
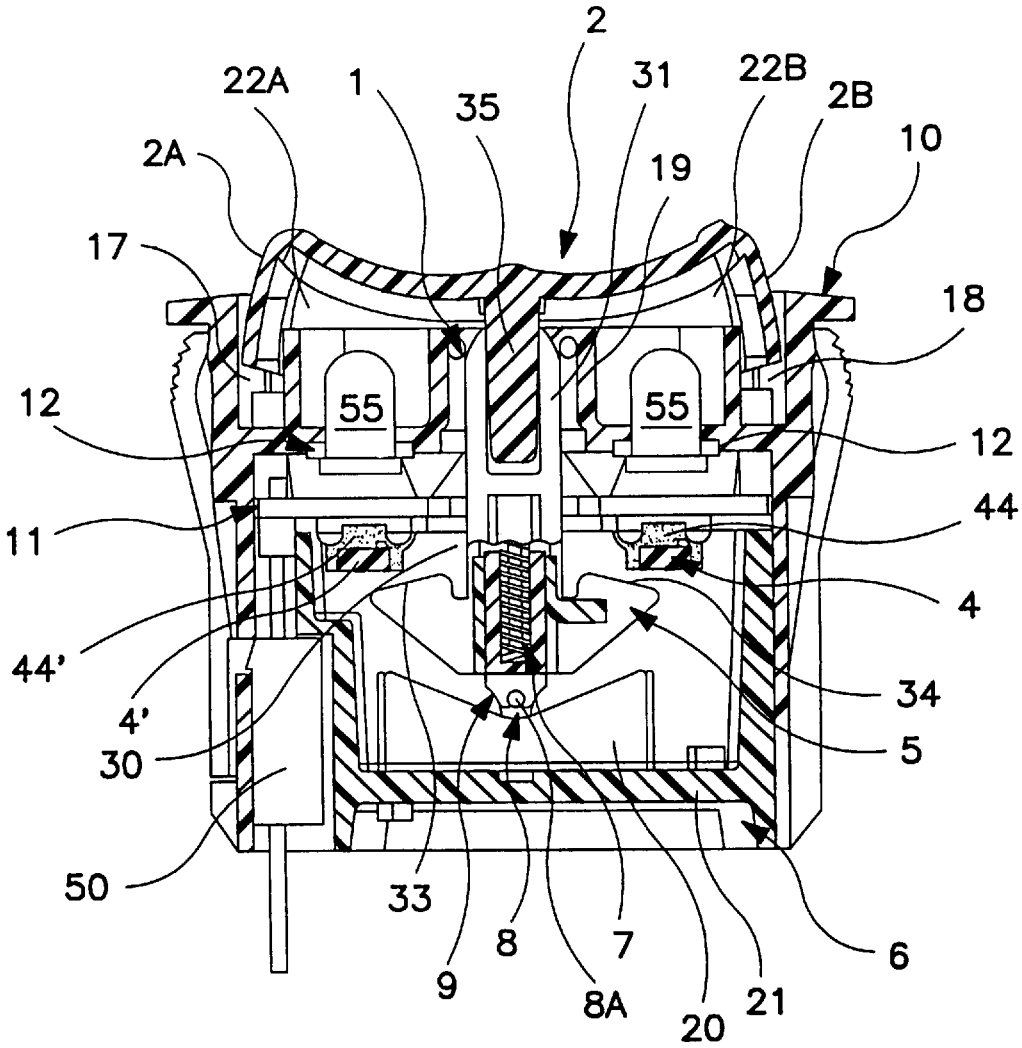
FIG. 2 is a cross-sectional view of the switch in accordance with the present invention.
FIG. 2B is a bottom view of a printed circuit board in accordance with the present invention.
Figure 2B:
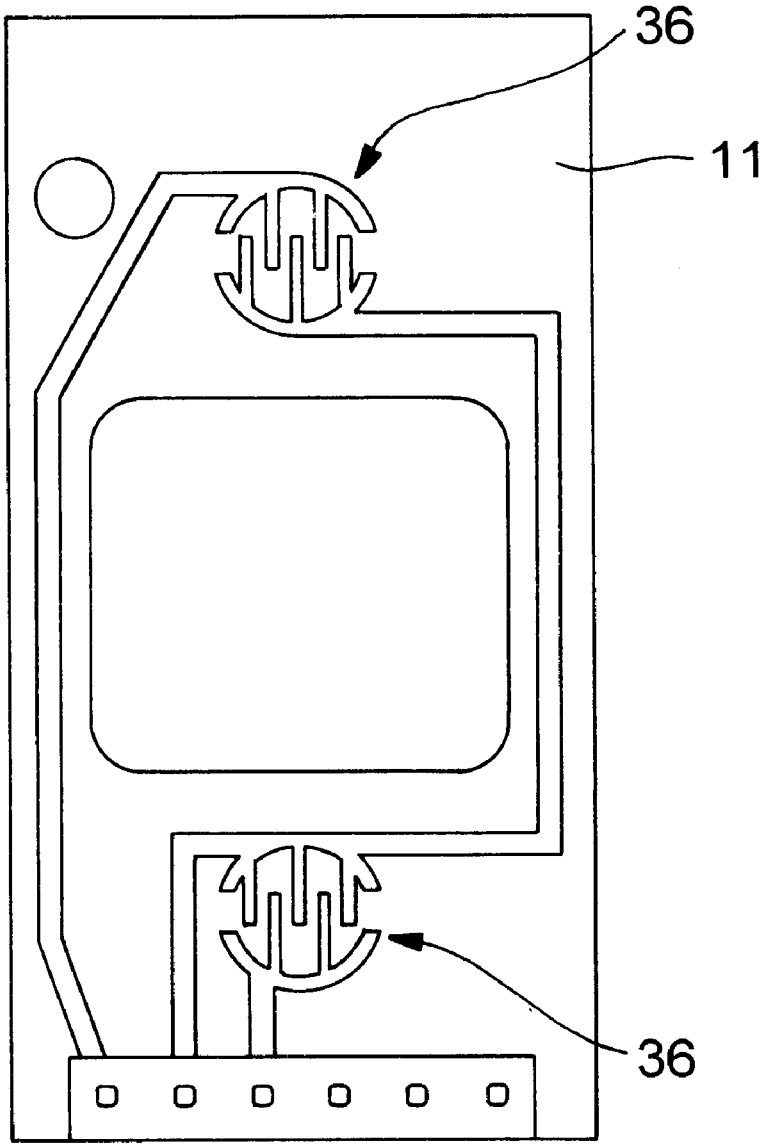

FIG. 2 illustrated the inner components of the switch. A detented ramp 20 is supported by base 21 in housing 10. The ramp 20 has a generally V-shaped side elevation, defined by a central valley and symmetrically opposite upwardly extending ends extending from the central valley. A lever 30 includes a slotted main body portion 31 which houses a compression spring 7. An O-ring 1 seals the main body about member 19 in housing 10. The lever 30 is preferably centrally located in the housing 10, and terminates in spring-loaded plunger 9, which is generally trapezoidal in cross-section. The plunger 9 holds at its free end a roller wheel 8 that is rotatable about axis 8A. The wheel 8 rests and slides on detented ramp 20 upon actuation of the lever about a vertical axis defined by the longitudinal axis of the main body portion 31. Spring 7 biases the wheel 8 against the ramp 20.

Extending outwardly from lever 30 is a yoke 5. The yoke has a pair of ears formed on opposite sides of the lever main body 31 in the direction of pivotable motion of the lever 30. The pair of ears having opposite contact surfaces 33, 34, each of which are positioned and configured to contact a respective keypad 4 or 4', depending upon the particular actuation of lever 30. The contact surfaces 33, 34 are metal coated, preferably gold plated to reduce or eliminate oxidation.

The keypads 4, 4' are preferably comprised of carbon contact discs or "pills" housed in an elastomer. The elastomer is sealed against a printed circuit board 11 by a switch housing retention member, and contains the carbon disc 44, 44'. When the base 21 of the housing 10 is inserted into the housing 10, such as by a snap fit, the elastomeric keypads 4, 4' are compressed against the printed circuit board 11, creating a seal. Suitable plating, such as electro-tin plating or bright solder plate, will function effectively, although the elastomeric switch and integral carbon-based disc 44 are optimized for use with gold plated contact fingers. The printed circuit board 11 includes foil patterns 36 (FIG. 2B) for single pole switch contacts, such that when the carbon disc 44, 44' from one of the keypads contacts the board 11, the circuit is completed. The contact between the carbon discs and the circuit board 11 is created by actuation of the lever 30 as discussed in greater detail below. One or more printed circuit boards 11 can be used.

In the embodiment shown, a rocker 2 is positioned in the top of the housing 10. The rocker 2 includes a centrally located extension 35 that seats in the slot of the main body 31 of lever 30, thus connecting the lever 30 to the rocker 2. The rocker 2 has opposite sides 2A and 2B that extend in the same general direction as extension 35 and are positioned in respective cavities 17, 18 of the housing 10. The cavities 17, 18 are dimensioned larger than the respective sides 2A, 2B such that the sides are movable in the cavity upon actuation of the rocker 2. Rocker 2 has a generally convex bottom surface, such that when in its neutral position as shown in FIG. 2, the center portion of the rocker 2 rests on the top surface of member 19, leaving gaps 21A and 21B between that top surface and the curved portions of the rocker 2 bottom surface. These gaps 22A and 22B allow the rocker 2 to be depressed in one direction or the other, which causes the extension 35 to pivot about a vertical axis defined by the longitudinal centerline of the extension 35, in turn causing pivoting of the lever 30 and thus the sliding of wheel 8 on ramp 20.

The switch can be configured in standard or momentary single pole or double through configurations.

The printed circuit(s) on the circuit board 11 are in electrical communication with connector 50, which is preferably integrally designed into the switch insulator (housing) and extends out of the housing 10 through an aperture therein as shown. Preferably the connector 50 is a standard circuit board mount inline header connector. The connector 50 can be placed in electrical communication with a digital circuit or a microprocessor, for example, causing the circuit to sequence through multiple pre-set functions. Thus, the switch is capable of interfacing with low current (high impedance) circuitry such as digital I/O and microprocessors, using relatively small connectors with small-gauge interconnection wiring such as ribbon cable or flex cable.

One or more light emitting diodes (LED) 55 can be positioned in the housing 10 for back lighting and/or indication of function activation. An O-ring 12 seals each of the diodes 55 in place. The LED can include leads custom formed for surface mount placement and soldering.

Figure 3:
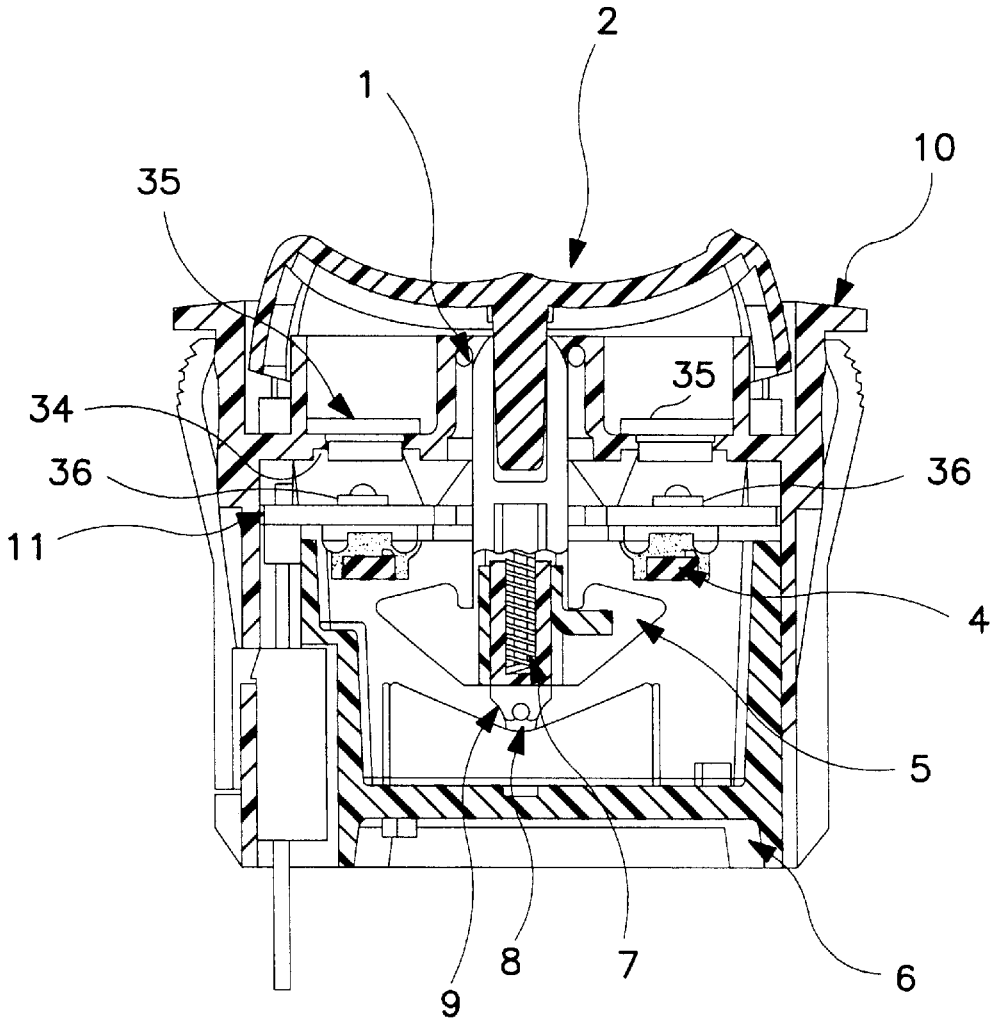
FIG. 3 is a cross-sectional view of the switch in accordance with an alternative embodiment of the present invention.

Alternatively, the switch of the present invention can have appropriate apertures or lenses making the diode visible to the user. For example, with reference to FIG. 3, one or more, preferably a pair, of diverging lenses 35 can be positioned in the apertures 34 previously filled by the diodes 55 in the embodiment of FIG. 2. Ultrasonic welding or insert molding are preferred forms of attachment. The LED diodes 36 can be surface mounted to the printed circuit board 11. Preferably the lenses 35 accept the narrow (e.g., 30 degree) viewing angles of the surface mounted LED diodes 36, thus expanding them and enhancing their appearance to the user. Back lighting of the indicia (e.g., graphics) on the rocker 2 is improved. In addition, the custom lead forming of the diodes 55 and the O-ring sealing are eliminated. A suitable lens 35 is an optically clear ABS/polycarbonate having concave surfaces with a high polish finish.

The diodes can be assembled to the printed circuit board, controlled from a separate external source (not shown), or controlled by the rocker switch action (dependent and/or independent lighting).

Low (microamp to low milliamp) current switching is thus provided, in a package that is inherently sealed, environmentally protected, and free from the corrosion/oxidation problems (and associated poor/intermittent contact resistance and leakage current) common with conventional rocker switches while retaining the cosmetic and ergonomic feel and mechanical mounting ease of a rocker switch.

What is claimed is:

1. A switch assembly, comprising:

a housing;

an actuator pivotably mounted in said housing;

a detent surface in said housing;

a lever in said housing and coupled to said actuator, said lever having a spring biased plunger, a wheel extending from said plunger, and at least one contact member, said lever being movable in response to actuator movement between at least a first neutral position and a second contact position by sliding engagement of said wheel on said detent surface; and a printed circuit board in said housing, said printed circuit board having at least one circuit;

whereby selective actuation of said actuator causes movement of said lever to said second contact position, causing said contact member to complete one of said at least one circuit on said printed circuit board.

2. The switch assembly of claim 1, wherein said lever has at least a second contact member and said printed circuit board has at least two circuits, and said lever is movable between said first neutral position, said second contact position, and a third contact position wherein said second contact member completes one of said at least two said circuit on said printed circuit board.

3. The switch assembly of claim 1, wherein said contact member has a contact surface comprising gold plating.

4. The switch assembly of claim 1, further comprising a carbon disc sealed to said printed circuit board with an elastomer, said carbon disc positioned to contact said at least one circuit on said printed circuit board when contacted by said contact member.

5. The switch assembly of claim 1, wherein said actuator is a rocker pivotable in said housing and coupled to said lever.

6. The switch assembly of claim 1, further comprising signal indication means in electrical communication with said printed circuit board in said housing for indicating the position of said lever.

7. The switch assembly of claim 6, wherein said signal indication means comprises a light emitting diode.

8. The switch assembly of claim 7, further comprising a lens in said housing for enhancing the light emitted from said diode.

9. The switch assembly of claim 1, further comprising an inline header connector in electrical communication with said printed circuit board and extending from said housing.

* * * * *